United States Patent [19]

Kirkland, Jr.

[11] Patent Number: 4,639,196

[45] Date of Patent: Jan. 27, 1987

[54] FLUID CONTROL VALVE

[75] Inventor: Thomas R. Kirkland, Jr., Mooresville, N.C.

[73] Assignee: Ingersoll-Rand Company, Woodcliff Lake, N.J.

[21] Appl. No.: 828,673

[22] Filed: Feb. 12, 1986

[51] Int. Cl.[4] ..... F16K 31/122

[52] U.S. Cl. ..... 417/228; 251/63; 251/63.5; 418/84

[58] Field of Search ..... 251/63, 63.5; 417/228; 418/84

[56] References Cited

U.S. PATENT DOCUMENTS

| | | | |
|---|---|---|---|
| 843,391 | 2/1907 | Ferris | 251/63 |
| 952,605 | 3/1910 | Connors et al. | 251/63 |
| 1,023,187 | 4/1912 | White | 251/63 |
| 1,224,221 | 5/1917 | Schwanebeck | 251/63 |
| 1,319,404 | 10/1919 | McGuire et al. | 251/63.5 |
| 1,436,768 | 11/1922 | Mackie et al. | 137/625.5 |
| 2,654,532 | 10/1953 | Nichols | 417/228 X |
| 4,172,582 | 10/1979 | Bobnar | 251/63 |

*Primary Examiner*—Gerald A. Michalsky
*Attorney, Agent, or Firm*—Bernard J. Murphy

[57] ABSTRACT

The valve has a cylindrical, cartridge-like housing in which a piston is slidably disposed. The piston subdivides the housing into an outer chamber, at one housing end, into which oil under pressure is admitted, and an inner chamber from which oil is discharged. Ports formed in the housing open onto the inner chamber and allow the oil to pass therethrough and on into an associated air compressor. The other end of the valve housing defines a control chamber. The piston has a depending, cylindrical shank which (a) moves into, and removes from, the control chamber, and (b) has a disc, fixed onto the end of the shank, which is sealingly engaged with the wall of the control chamber. Channels are formed in the periphery of the piston, to allow oil to flow from the outer chamber to the inner chamber, but a land in the housing defines a seat for the piston which, when the piston closes thereupon, interdicts the aforesaid oil flow. A pilot, compressed air supply, tapped off from the compressed air discharge line of the associated air compressor, is admitted into the control chamber to displace the disc and unseat the piston. In the absence of the pilot supply then, as when the air compressor is shut down, the oil pressure in the outer chamber seats the piston, sealingly, on the land.

12 Claims, 3 Drawing Figures

FLUID CONTROL VALVE

This invention pertains to fluid control valves and, in particular, to an oil control valve designed especially for use in an air compressor to control and, especially, to interdict the flow of oil to the air compressor. Air compressors, particularly oil-flooded, rotary screw compressors require a constant flow of oil to help seal the compression cycle of the screws, carry away the heat of compression to heat exchangers, and to lubricate bearings and seals.

Controlling this flow of oil is critical, and one method of control is the use of an oil stop valve (O.S.V.). The O.S.V. stops the flow of oil when the compressor stops, preventing overflow and the possibility of hydraulic lock upon restart. Usually the O.S.V. is controlled electrically, by means of a solenoid valve and, consequently, entails a costly and complicated system.

Other O.S.V. types require no electrical control. Such fluid control valves are like that disclosed in U.S. Pat. No. 2,654,532, issued on Oct. 6, 1953, to T. W. Nichols for a "Rotary Compressor". In the Nichols compressor, however, the valve must be spring loaded and the compressor housing must be especially configured, bored and tapped to accommodate the valve, valving elements, and piping thereto.

It is an object of this invention to disclose a fluid control valve, for controlling oil flow in and to a compressor, which requires no electrical controls, and no spring biasing, and which comprises a simple, cartridge-type housing to facilitate its employment in a compressor housing.

It is also an object of this invention to set forth a fluid control valve comprising a housing having a given axis; and (b) subdividing said housing into inner and outer chambers; first means for admitting fluid into said outer chamber; and second means for discharging fluid from said inner chamber; wherein said piston has conduit means for effecting fluid communication between said chambers; and further including a land, in said housing, intermediate opposite ends of said housing; and wherein said piston has a shoulder for closure thereof onto, and for removal thereof from, said land to interdict, and to permit, fluid communication between said chambers.

Further objects of this invention, as well as the novel features thereof, will become more apparent by reference to the following description taken in conjunction with the accompanying figures, in which.

Figure 3:
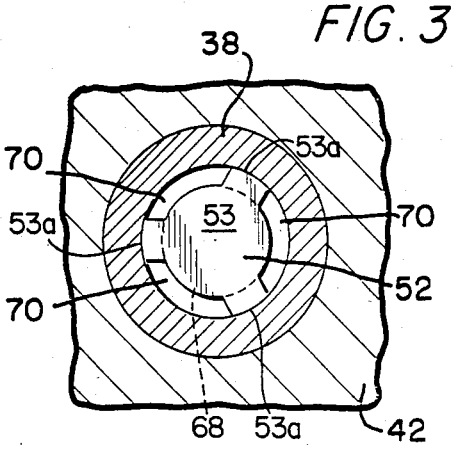
Figure 1:
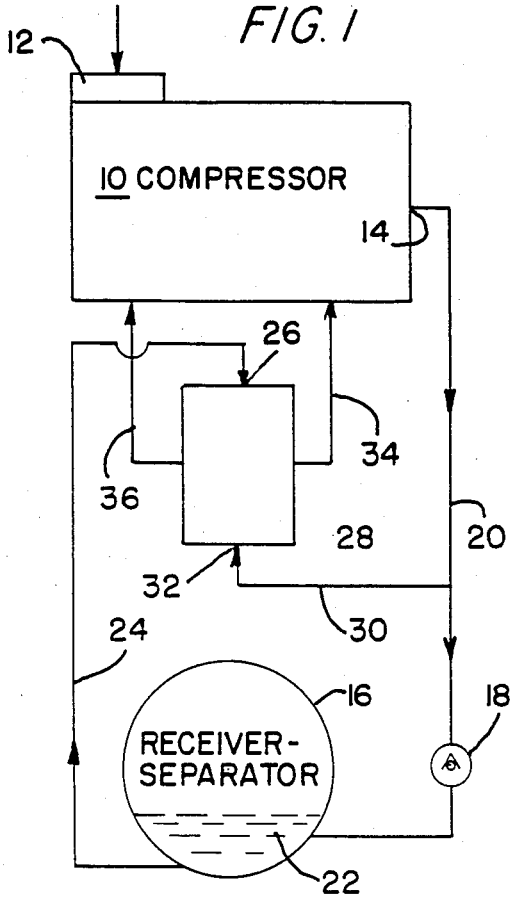
FIG. 1 is a schematic diagram of an air compressor and receiver arrangement in which the novel fluid control valve is employed.

As shown in the figures, an air compressor 10 has an inlet 12 at one end and a compressed air outlet 14 at the other end. Outlet 14 supplies the compressed air product to a receiver-separator tank 16 by way of a check valve 18, via a line 20. The receiver-separator tank 16 confines therewithin the compressed air product and a reservoir 22 of oil which has been separated from the compressed air. A line 24 communicates between the oil reservoir 22 and the oil inlet 26 of the novel valve 28, and a tap line 30, taken from the line 20, communicates with the pilot signal port 32 of the valve 28.

Two further lines 34 and 36 communicate between the valve 28 and the compressor 10 for supplying lubricating, cooling, and sealing oil to the compressor through the valve 28.

Figure 2:
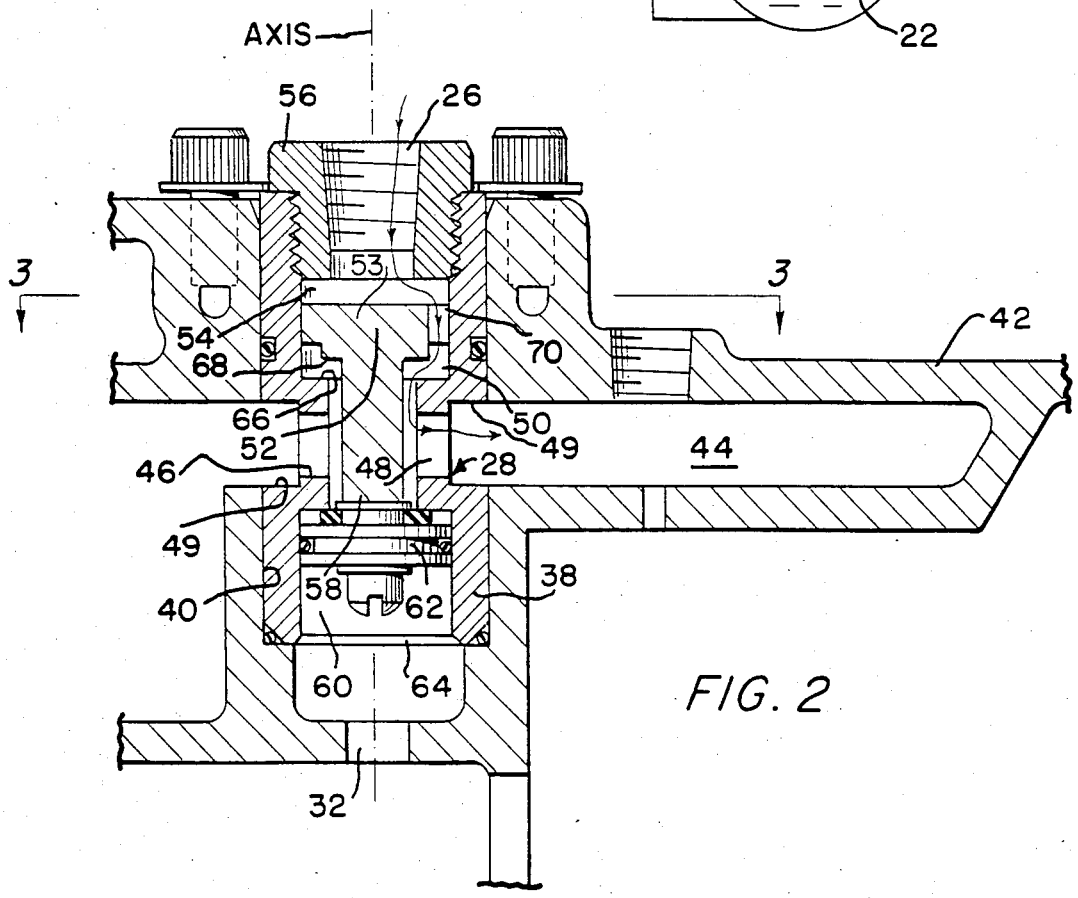
FIG. 2 is a cross-sectional view of a portion of a compressor housing structure showing a preferred embodiment of the novel fluid control valve operatively disposed therein; and, FIG. 3 is a cross-sectional view taken along section 3—3 of FIG. 2.

As shown in FIGS. 2 and 3, the preferred embodiment of the valve 28 comprises a cylindrical housing 38, having a bounding, circumferential, inner wall, which is slidably received in a cylindrical bore 40 provided therefor in a compressor housing structure 42. The bore 40 is disposed within a channel 44 through which oil is intended to flow to bearings, and rotors, and the like, within the compressor housing 42. Intermediate the length of the cylindrical valve housing 38, and opening onto the channel 44, are a pair of ports 46 and 48 for discharging oil from an inner chamber 50 of the valve housing 38.

A piston 52 movable within the valve housing 38 has a head 53 which subdivides the latter into the aforesaid inner chamber 50 and an outer chamber 54. The outer chamber 54 has threaded therein a reducing bushing 56, and oil is supplied therethrough under pressure, into the outer chamber 54. The piston 52 has a cylindrical shank 58 which reaches into a control chamber 60 where a disc 62 is coupled to the termination of the shank. An aperture 64 opens into the control chamber 60 for admitting thereinto a pilot, pressured supply of air from the compressor 10. When the compressor 10 is operating, the pilot pressure displaces the disc 62 and, thereby, keeps the piston 52 raised from a land 66 formed within the valve housing 38 so that a shoulder 68 under the head 53 is removed therefrom. In these circumstances, the oil may pass through channels 70 axially formed in the periphery of the piston to pass into the inner chamber 50. The channels 70 interrupt the outermost circumferential surfaces **53*a*, of the head 53, which surfaces engage the bounding, circumferential, inner wall of the housing 38 for guiding the piston 52 in its travel, axially, in the housing. After the oil passes into the inner chamber 50, the oil discharges through the ports 46 and 48, and into a radial slot 49 formed around the circumference of valve housing 38. Slot 49 communicates with channel 44 so that orientation of ports 46 and 48 need not be in the same axis as channel 44. When the compressor 10 is shut down, the pilot pressure, of course, no longer exists at aperture 64, and the pressure of the oil in chamber 54 causes the piston 52 to seat against the land 66** and thereby interdict the flow of oil through the ports.

The novel valve 28 requires no electrical actuation, and needs no spring biasing. It responds solely to the pressure differential thereacross, and is of simple construction which necessitates, therefore, little maintenance. The valve is efficiently packaged and self-contained in its cartridge-like housing 38, the latter being set, with appropriate seals, in the straight bore 40 in the compressor housing structure 42.

While I have described my invention in connection with a specific embodiment thereof, it is to be clearly understood that this is done only by way of example and not as a limitation to the scope of my invention as set forth in the objects thereof and in the appended claims.

I claim:

1. A fluid control valve, comprising:

a housing having a given axis and a bounding, circumferential, inner wall;

a piston, in said housing, having a head (a) movable along said axis, and (b) subdividing said housing into inner and outer chambers;

first means for admitting fluid into said outer chamber; and second means for discharging fluid from said inner chamber; wherein said head has outermost, circumferential surfaces engaged with said wall for guiding said piston in its axial movement;

said head has conduit means for effecting fluid communication between said chambers; and further including a land, in said housing, intermediate opposite ends of said housing; wherein said head has a shoulder for closure thereof onto, and for removal thereof from, said land to interdict, and to permit, fluid communication between said chambers;

said conduit means comprises a plurality of channels formed in said head;

said outermost circumferential surfaces are interrupted by said channels of said plurality thereof; and said channels are radially outwardly disposed, relative to said shoulder.

2. A fluid control valve, according to claim 1, wherein:

said housing has an aperture formed therein for admitting a piston-displacing pressured fluid therethrough to said piston to move said piston and, consequently, to remove said shoulder from said land.

3. A fluid control valve, according to claim 2, wherein:

said housing further has a control chamber formed therein; and said aperture comprises an opening into said control chamber.

4. A fluid control valve, according to claim 3, wherein:

said control chamber opens directly onto one of said inner and outer chambers; and further including sealing means, within said control chamber, preventing fluid communication between said opening and said one chamber.

5. A fluid control valve, according to claim 1, wherein:

said housing comprises a cylinder;

said second means comprises a port formed in said cylinder intermediate the ends thereof;

said first means comprises an opening at one of said cylinder ends; and said land comprises an annular rib, formed in said cylinder, and extending inwardly.

6. A fluid control valve, according to claim 1, wherein:

said piston further has a cylindrical shank movably disposed within said inner chamber;

said housing further has a walled control chamber formed therein;

said shank has a termination which, upon piston movement, intrudes into and withdraws from said control chamber; and further including a disc coupled to said termination of said shank, and sealingly engaged with the walls of said control chamber; and an aperture, formed in said housing, and opening into said control chamber, for admitting a piston-displacing, pressured fluid therethrough to said disc.

7. In combination, a gas compressor, an oil reservoir, means for conducting oil from said reservoir into said gas compressor, and a fluid control valve, interposed in said oil conducting means, comprising:

a gas compressor housing structure;

an oil-conducting passageway within said structure;

a cylindrical bore formed in said structure and in traverse of said passageway;

a cylindrical valve housing removably fastened in said bore; wherein:

said valve housing has a given axis and a bounding circumferential, inner wall; and further including a piston, in said valve housing, having a head (a) movable along said axis, and (b) subdividing said valve housing into inner and outer chambers;

wherein said valve housing has means for admitting oil from said reservoir into said outer chamber; and said valve housing also has means for discharging oil from said inner chamber into said oil-conducting passageway of said compressor housing structure;

said head has outermost, circumferential surfaces engaged with said wall for guiding said piston in its axial movement;

said head has conduit means for effecting fluid communication between said chambers; and further including a land, in said valve housing, intermediate opposite ends thereof; wherein said head has a shoulder for closure thereof onto, and for removal thereof from, said land to interdict, and to permit, fluid communication between said chambers;

said conduit means comprises a plurality of channels formed in said head;

said outermost circumferential surfaces are interrupted by said channels of said plurality thereof; and said channels are radially outwardly disposed, relative to said shoulder.

8. The combination, according to claim 7, wherein:

said valve housing further has an aperture formed therein for admitting a piston-displacing pressured fluid therethrough to move said piston and, consequently, to remove said shoulder from said land.

9. The combination, according to claim 8, wherein:

said valve housing further has a control chamber formed therein; and said aperture comprises an opening into said control chamber.

10. The combination, according to claim 9, wherein:

said control chamber opens directly onto one of said inner and outer chambers; and further including sealing means, within said control chamber, preventing fluid communication between said opening and said one chamber.

11. The combination, according to claim 7, wherein:

said oil-discharging means comprises a port formed in said valve housing intermediate the ends thereof;

said oil-admitting means comprises an opening at one of said opposite ends of said valve housing; and said land comprises an annular rib, formed in said valve housing, and extending inwardly.

12. The combination, according to claim 7, wherein:

said piston further has a cylindrical shank movably disposed within said inner chamber;

said valve housing further has a walled control chamber formed therein;

said shank has a termination which, upon piston movement, intrudes into and withdraws from said control chamber; and further including a disc coupled to said termination of said shank, and sealingly engaged with the walls of said control chamber; and an aperture, formed in said valve housing, and opening into said control chamber, for admitting a piston-displacing, pressured fluid therethrough to said disc.

* * * * *

UNITED STATES PATENT AND TRADEMARK OFFICE

CERTIFICATE OF CORRECTION

PATENT NO. : 4,639,196

DATED : 27 January 1987

INVENTOR(S) : Thomas R. Kirkland, Jr.

It is certified that error appears in the above—identified patent and that said Letters Patent is hereby corrected as shown below:

Column 1, between lines 35 and 36, insert:

-- a piston in said housing (a) movable along said axis, --

Signed and Sealed this

Twenty-first Day of April, 1987

*Attest:*

DONALD J. QUIGG

*Attesting Officer*

*Commissioner of Patents and Trademarks*